US005740703A

United States Patent [19]

Perry

[11] Patent Number: 5,740,703

[45] Date of Patent: Apr. 21, 1998

[54] POWER WRENCH APPARATUS HAVING A POSITIVE SLIDING CLAMP

[76] Inventor: Robert G. Perry, 5335 E. Terrace Ave., Indianapolis, Ind. 46203

[21] Appl. No.: 579,119

[22] Filed: Dec. 27, 1995

[51] Int. Cl.[6] ..... B25B 13/50

[52] U.S. Cl. ..... 81/57.34; 81/57.36; 81/57.41

[58] Field of Search ..... 81/57.33, 57.34, 81/57.35, 57.36, 57.4, 57.41, 57.42, 268, 272, 25, 27, 32, 43, 34; 269/35

[56] References Cited

U.S. PATENT DOCUMENTS

| | | | |
|---|---|---|---|
| 1,837,645 | 12/1931 | Baash et al. | 269/25 |
| 2,061,369 | 11/1936 | Prendergast et al. | 269/268 |
| 2,150,611 | 3/1939 | Speck . | |
| 2,405,757 | 8/1946 | Rowland . | |
| 2,509,853 | 5/1950 | Wilson . | |
| 2,552,521 | 5/1951 | Coshow . | |
| 2,668,689 | 2/1954 | Cormany . | |
| 2,862,690 | 12/1958 | Mason . | |
| 2,952,177 | 9/1960 | Skillin . | |
| 2,979,320 | 4/1961 | Adams . | |
| 3,203,737 | 8/1965 | Robbins et al. . | |
| 3,227,419 | 1/1966 | Lackey . | |
| 3,521,509 | 7/1970 | Duke et al. . | |
| 3,550,485 | 12/1970 | Dickmann . | |
| 3,726,506 | 4/1973 | Vanderwaal et al. . | |
| 3,799,010 | 3/1974 | Guier . | |
| 3,807,695 | 4/1974 | Gremillion et al. . | |
| 3,832,918 | 9/1974 | Lang et al. . | |
| 3,834,668 | 9/1974 | Casey . | |
| 3,907,253 | 9/1975 | Schosek . | |
| 3,951,216 | 4/1976 | Crawshay et al. . | |
| 3,957,113 | 5/1976 | Jones et al. . | |
| 4,000,879 | 1/1977 | Martin et al. . | |
| 4,070,010 | 1/1978 | Brasca | 269/27 |
| 4,082,017 | 4/1978 | Eckel | 81/57.34 |
| 4,092,881 | 6/1978 | Jürgens et al. . | |
| 4,095,493 | 6/1978 | Haynes . | |
| 4,170,907 | 10/1979 | Cathcart . | |
| 4,246,809 | 1/1981 | Keast et al. . | |
| 4,251,065 | 2/1981 | McDougal | 269/25 |
| 4,333,365 | 6/1982 | Perry . | |
| 4,368,873 | 1/1983 | Perry . | |
| 4,821,814 | 4/1989 | Willis et al. . | |
| 4,936,708 | 6/1990 | Perry . | |
| 5,015,124 | 5/1991 | Perry . | |
| 5,231,899 | 8/1993 | Lee . | |
| 5,520,072 | 5/1996 | Perry | 81/57.16 |

FOREIGN PATENT DOCUMENTS

| | | | |
|---|---|---|---|
| 694604 | 10/1979 | U.S.S.R. . | |
| 605076 | 7/1948 | United Kingdom | 269/27 |

*Primary Examiner*—D. S. Meislin
*Assistant Examiner*—Joni B. Danganan
*Attorney, Agent, or Firm*—Barnes & Thornburg

[57] ABSTRACT

A tong apparatus is provided for gripping a pipe. The apparatus includes a support having a track, a first positive stop, and a second positive stop. The apparatus also includes a jaw assembly having a base slidably coupled to the track of the support. The jaw assembly includes a cylinder having a movable piston. The cylinder is rigidly coupled to the base. The jaw assembly also includes a clamp for gripping the pipe. The clamp has a first jaw coupled to the movable piston and a second jaw coupled to the base. The first jaw has at least one stop located between the first and second positive stops of the support so that when the piston is extended from the cylinder the first jaw initially moves toward the second jaw until the first jaw engages the first positive stop. Further extension of the piston causes the base, the cylinder, and the second jaw to move relative to the support toward the first jaw until the second jaw engages the pipe to grip the pipe and prevent rotation of the pipe relative to the jaw assembly.

25 Claims, 6 Drawing Sheets

POWER WRENCH APPARATUS HAVING A POSITIVE SLIDING CLAMP

BACKGROUND AND SUMMARY OF THE INVENTION

The present invention relates to an improved power wrench apparatus. More particularly, the present invention relates to a power wrench or tong apparatus and a cooperating backup wrench or tong apparatus which include positive sliding clamps for breaking connections between links of pipe as the pipe is being removed from the ground.

It is well known to push a rod or pipe through the ground with a drilling rig from one location to another predetermined location beneath the surface of the ground. For example, a pipe may be pushed under a road from one side of the road to another without creating a trench in the road. Generally speaking, apparatus for directing forward movement of a pipe through the ground beneath the surface of the ground are known in the art. Drilling rigs are also used to drill into the ground for oil wells or the like. Typically, these drilling rigs rotate the pipe in a counterclockwise direction or a clockwise direction to install or remove pipe from the ground.

Making and breaking apparatus are known for making up or breaking out joints between adjacent pipes which are driven into the ground with known drilling rigs. As the pipe is being removed from the ground, joints between adjacent sections must be loosened to permit the next section of pipe to be removed from the ground.

The power wrench apparatus of the present invention includes two separate wrenches or tongs operating in conjunction with each other. A backup tong is provided to grip and hold a lower section of pipe which extends into the ground stationary. A power tong is provided to grip and rotate an upper section of pipe which is connected to the lower section of pipe in the ground. While the backup tong prevents rotation of the lower length of pipe, the power tong grips and rotates the upper section of pipe to break the joint between the upper and lower pipe sections.

Clamps or jaws of the power tong and the backup tong are configured to enter elongated slots formed in supports to permit limited sliding movement of the jaw assemblies relative to the supports. Therefore, the entire jaw assembly can slide relative to the support. The power tong and the backup tong both include a pair of positive stops to limit movement of the jaw assemblies. These positive stops provide improved positioning of the pipes relative to the power tong and backup tong while still permitting the jaws to slide relative to the supports.

According to one aspect of the present invention, a tong apparatus is provided for gripping a pipe. The apparatus includes a support having a track, a first positive stop, and a second positive stop. The apparatus also includes a jaw assembly having a base slidably coupled to the track of the support. The jaw assembly includes a cylinder having a movable piston. The cylinder is rigidly coupled to the base. The jaw assembly also includes a clamp for gripping the pipe. The clamp has a first jaw coupled to the movable piston and a second jaw coupled to the base. The first jaw has at least one stop located between the first and second positive stops of the support so that when the piston is extended from the cylinder the first jaw initially moves toward the second jaw until the first jaw engages the first positive stop. Further extension of the piston causes the base, the cylinder, and the second jaw to move relative to the support toward the first jaw until the second jaw engages the pipe to grip the pipe and prevent rotation of the pipe relative to the jaw assembly.

In the illustrated embodiment, the base of the jaw assembly includes first and second flanges located in the track of the support. The support includes a pair of spaced apart side walls. Each side wall is formed to include an elongated groove to define the track.

Also in the illustrated embodiment, the first and second jaws are formed to include a plurality of teeth for gripping the pipe. The plurality of teeth on the first and second jaws are formed by removable wedge plates.

In the illustrated embodiment, the first and second jaws each include an inwardly projecting retention finger to block movement of the pipe away from the first and second jaws. The apparatus also includes a bearing coupled to the support for receiving the pipe therethrough. The first positive stop is formed by a removable jaw guide coupled to the support.

Retraction of the piston initially causes the first jaw to move away from the pipe until the at least one stop on the first jaw engages the second positive stop of the support. Further retraction of the piston causes the base, the cylinder, and the second jaw to move relative to the support away from the first jaw so that the second jaw is disengaged from the pipe.

In one illustrated embodiment, the apparatus further includes a frame. The support is pivotably coupled to the frame. A pair of drive cylinders have movable pistons which are coupled to the support to rotate the support relative to the frame after the first and second jaws grip the pipe. The drive pistons are pivotably coupled to the support and the drive cylinders are pivotably coupled to the frame.

The frame and the support are each formed to include an arcuate groove. The apparatus includes an arcuate bearing member extending between the arcuate groove of the frame and the arcuate groove of the support to provide a bearing for pivotably coupling the support to the frame. In the illustrated embodiment, the bearing member and the arcuate grooves each have a semicircular shape.

According to another aspect of the invention, a break down tong apparatus is provided for breaking loose a connection between a first joint portion and a second joint portion connecting a first pipe and a second adjacent pipe, respectively. The apparatus includes a frame, and a backup tong including a first support rigidly coupled to the frame. The first support includes first and second positive stops. The backup tong also includes a first jaw assembly having a first base slidably coupled to the first support. The first jaw assembly includes a first cylinder having a first movable piston. The first cylinder is rigidly coupled to the first base. The first jaw assembly also includes a first clamp for gripping the first pipe. The first clamp has a first jaw coupled to the first movable piston and a second jaw coupled to the first base. The first jaw has at least one stop located between the first and second positive stops of the first support so that when the first piston is extended from the first cylinder the first jaw initially moves toward the second jaw until the first jaw engages the first positive stop of the first support. Further extension of the first piston causing the first base, the first cylinder, and the second jaw to move relative to the first support toward the first jaw until the second jaw engages the first pipe to grip the first pipe and prevent rotation of the first pipe relative to the first jaw assembly.

The break down tong apparatus also includes a power tong having a second support pivotably coupled to the frame adjacent the backup tong. The second support includes first and second positive stops. The power tong also includes a second jaw assembly having a second base slidably coupled to the second support. The second jaw assembly includes a second cylinder having a second movable piston. The second cylinder is rigidly coupled to the second base. The second jaw assembly also includes a second clamp for gripping the second pipe. The second clamp has a third jaw coupled to the second movable piston and a fourth jaw coupled to the second base. The third jaw has at least one stop located between the first and second positive stops of the second support so that when the second piston is extended from the second cylinder the third jaw initially moves toward the fourth jaw until the third jaw engages the first positive stop of the second support. Further extension of the second piston causing the second base, the second cylinder, and the fourth jaw to move relative to the second support toward the third jaw until the fourth jaw engages the second pipe to grip the second pipe and prevent rotation of the second pipe relative to the second jaw assembly.

The break down tong apparatus further includes dual drive cylinders coupled to the frame. The drive cylinders each have a drive piston coupled to the second support to rotate the power tong relative to the frame while the second jaw assembly is engaged with the second joint portion, thereby rotating the second joint portion relative to the first joint portion to break the connection between the first joint portion and the second joint portion.

In the illustrated embodiment, a bearing surrounds the pipe. The bearing is located adjacent the backup tong on an opposite side of the backup tong from the power tong. The drive pistons preferably rotate the power tong about 20° relative to the base to break the connection between the first joint portion and the second joint portion.

The first and second jaws each include an inwardly projecting retention finger to block movement of the pipe away from the first and second jaws. In the illustrated embodiment, the first positive stops are formed by a first removable jaw guide coupled to the first support and a second removable jaw guide coupled to the second support.

According to yet another embodiment of the present invention, a power tong apparatus is provided for gripping and rotating a pipe. The apparatus includes a frame having first and second frame members which are formed to include arcuate grooves, and a support having first and second support plates. Each of the first and second support plates have an outer side wall formed to include an arcuate groove aligned with the arcuate grooves in the first and second frame members. The apparatus also includes first and second arcuate floating bearing members extending between the arcuate grooves of the first and second support plates and the arcuate grooves of the first and second frame members to pivotably couple the support to the frame. The apparatus further includes a jaw assembly coupled to the first and second support members for gripping the pipe, and a drive mechanism coupled to the support for rotating the support relative to the frame.

In one illustrated embodiment, the arcuate grooves extend over a greater arcuate angle than the first and second floating bearing members. In another embodiment, the arcuate grooves and the first and second bearing members are all circular in shape.

Also in the illustrated embodiment, the drive mechanism includes a first drive cylinder having a first piston pivotably coupled to the first support plate. The drive mechanism also includes a second drive cylinder having a second piston pivotably coupled to the second support plate.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
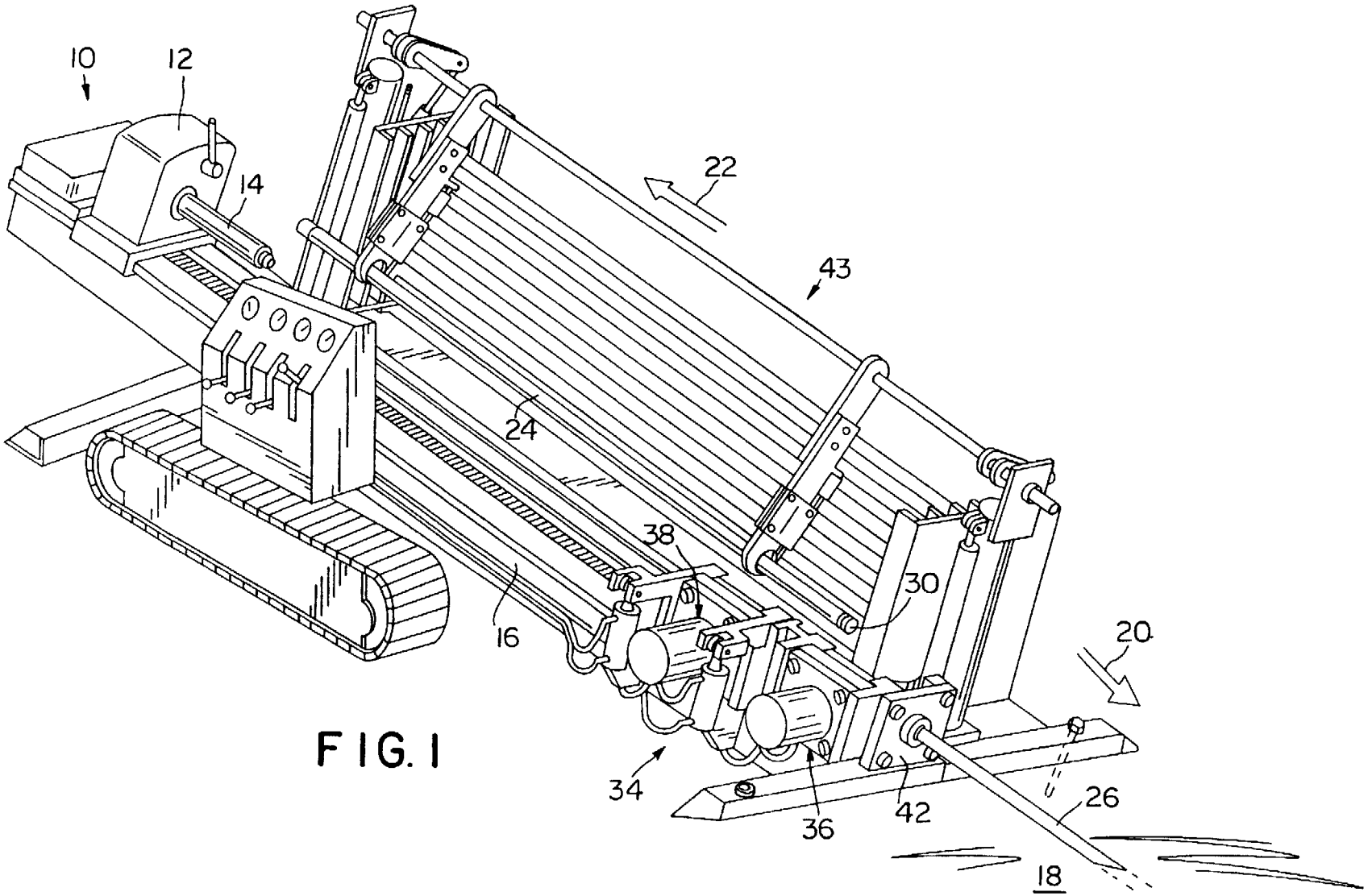
FIG. 1 is a perspective view of a drilling rig which includes the power wrench apparatus of the present invention and power pipe loader.

Referring now to the drawings, FIG. 1 illustrates drilling rig 10 including a main drive 12 having a threaded drive head 14. Main drive unit 12 is driven back and forth over frame 16. Main drive unit 12 rotates threaded drive head 14 to drive pipe sections 24 and 26 into the ground 18. After lower pipe 26 is driven into the ground 18, pipe 24 must be connected to a threaded end 32 (shown in FIG. 3) of lower pipe 26 in order to continue driving the pipe into the ground. Main drive 12 rotates drive head 14 and pushes the pipe in the direction of arrow 20 to move the pipe into the ground. Pipe is also removed from the ground 18 using main drive 12 which rotates and pulls the pipe in the direction of arrow 22.

In FIG. 1, an upper pipe section 24 is connected to threaded drive 14 and a lower pipe section 26 is coupled to upper pipe 24 by a joint which includes a male joint portion 30 on upper pipe 24 and a female joint portion 32 on lower pipe 26. In order to remove the upper pipe 24 from lower pipe 26, the joint between upper pipe 24 and lower pipe 26 must be broken. Although a portable drilling rig 10 is illustrated, it is understood that any type of drilling rig can be used in accordance with the present invention. Drilling rig 10 can be positioned in a horizontal position as illustrated in FIG. 1 or in a vertical position for drilling straight down into the ground.

A break down tong apparatus 34 is provided to break the connection between joint portions 30 and 32 as the pipe is removed from the ground. Break down tong apparatus 34 includes a backup tong apparatus 36 which grips lower pipe 26 and holds lower pipe 26 stationary. Break down tong apparatus 34 also includes a power tong apparatus 38 which grips and rotates the upper pipe 24 to break the connection between upper and lower joint sections 30 and 32. Break down tong apparatus 34 also includes a bearing 42 coupled to frame 16 adjacent backup tong apparatus 36. Bearing 42 surrounds lower pipe 26 to help align and stabilize the pipe as the pipe is driven into the ground to reduce wear and tear on the backup tong apparatus 36 and power tong apparatus 38 as the pipe is driven into the ground 18.

The preferred embodiment of the break down tong apparatus 34 is designed for use with a power pipe loader 43 which removes and stacks the pipes. It is understood that any type of conventional pipe loader may be used with the break down tong apparatus 34 of the present invention. In addition, the break down tong apparatus can be designed for standard end-loading of the pipes as discussed below.

Figure 2:
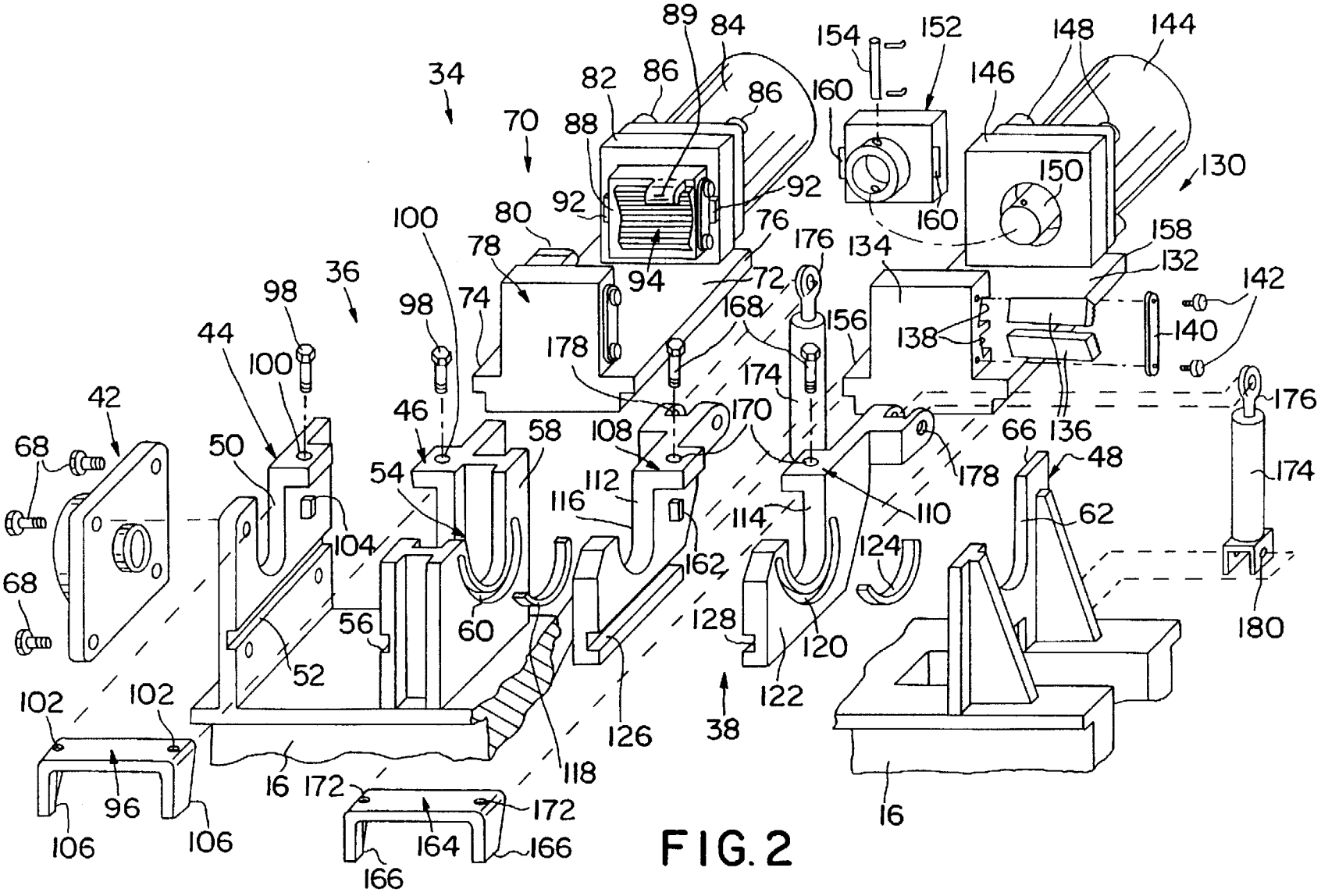
FIG. 2 is an exploded perspective view illustrating details of the power wrench apparatus of the present invention.
Figure 3:
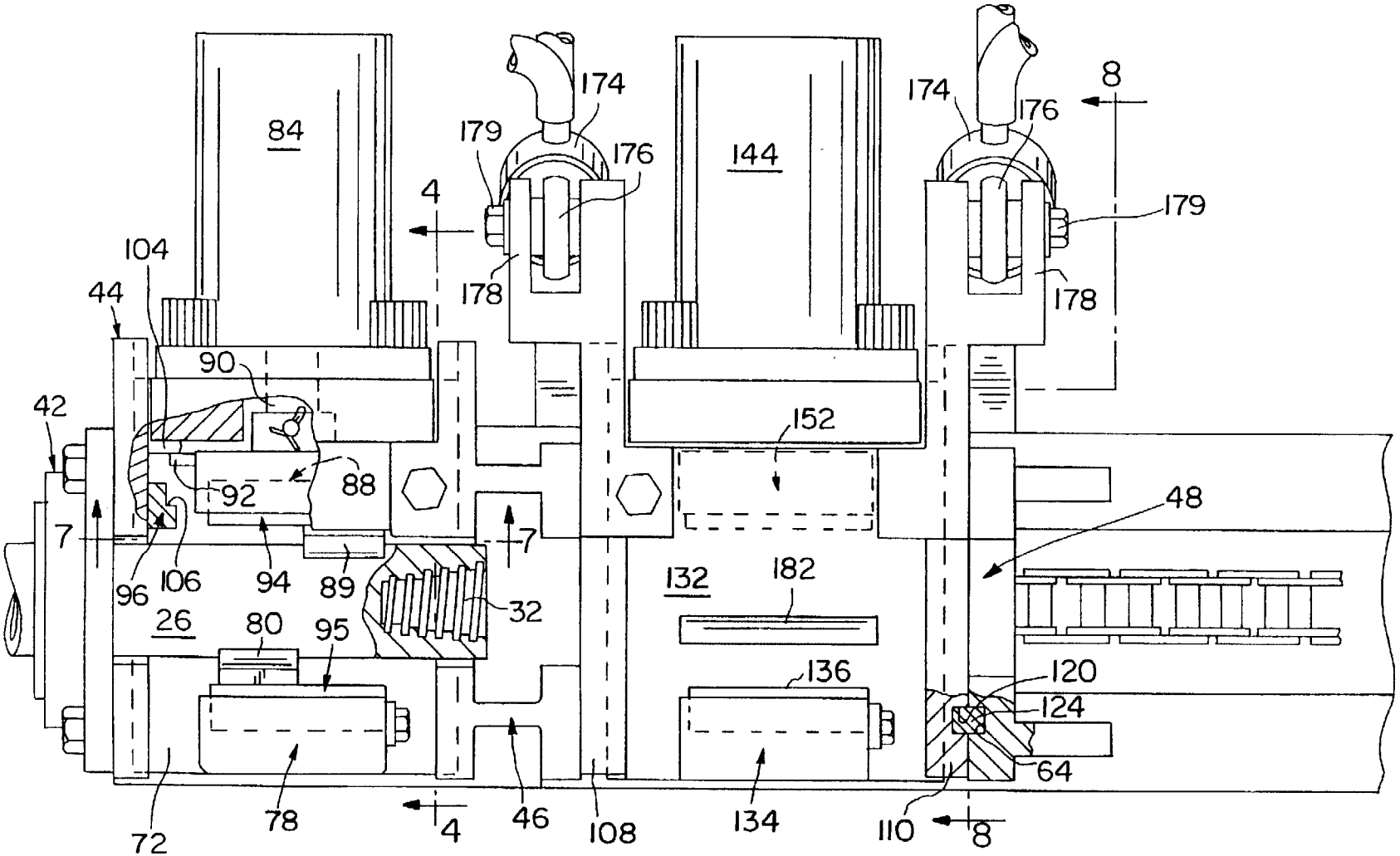
FIG. 3 is top plan view, with portions broken away, of the assembled power wrench apparatus of FIG. 2.

Further details of the break down tong apparatus 34 are illustrated in FIGS. 2 and 3. Break down tong apparatus 34 includes three spaced apart, fixed supports 44, 46, and 48 which are rigidly coupled to base 16. Support 44 includes a U-shaped opening 50 and an extended groove 52. Support 46 includes a similar U-shaped opening 54 and a similar groove 56 which faces groove 52 formed in support 44. An opposite side wall 58 of support 46 is formed to included a semi-circular groove 60. Support 48 is also formed to include a U-shaped aperture 62. A semi-circular groove 64 is formed in side wall 66.

The U-shaped apertures 50, 54, and 62 permit top loading of pipes into the break down tong apparatus 34 from loader 43. It is understood, however, that the supports 44, 46, and 48 could be formed with only a central aperture so that the pipes are loaded from an end of the break down tong apparatus 34 adjacent the support 48. In addition, the U-shaped apertures 50, 54, and 62 may be aligned at any desired angle (360°) to permit loading of the pipes from any orientation.

Bearing 42 is coupled to support 44 by suitable fasteners 68. Bearing 42 surrounds the lower pipe 26 to help align and stabilize the lower pipe 26 as it is driven into and pulled from the ground to reduce wear and tear on the breakdown tong apparatus 34. Breakup tong apparatus 36 includes a positive sliding jaw assembly 70 having a base 72. Base 72 includes opposite flanges 74 and 76 configured to slide within grooves 52 and 56 formed in supports 44 and 46, respectively. Base 72 also includes an upwardly extending jaw 78 having a pipe retention finger 80 extending therefrom. Base 72 includes a fixed support wall 82. A cylinder 84 is coupled to support wall 82 by suitable fasteners 86. Another jaw 88 is coupled to a piston 90 of cylinder 84. Jaw 88 includes a pipe retention finger 89 and stops 92 extending away from opposite sides of the jaw 88. Removable teeth 94 are coupled to second jaw 88 as discussed below.

Figure 7:
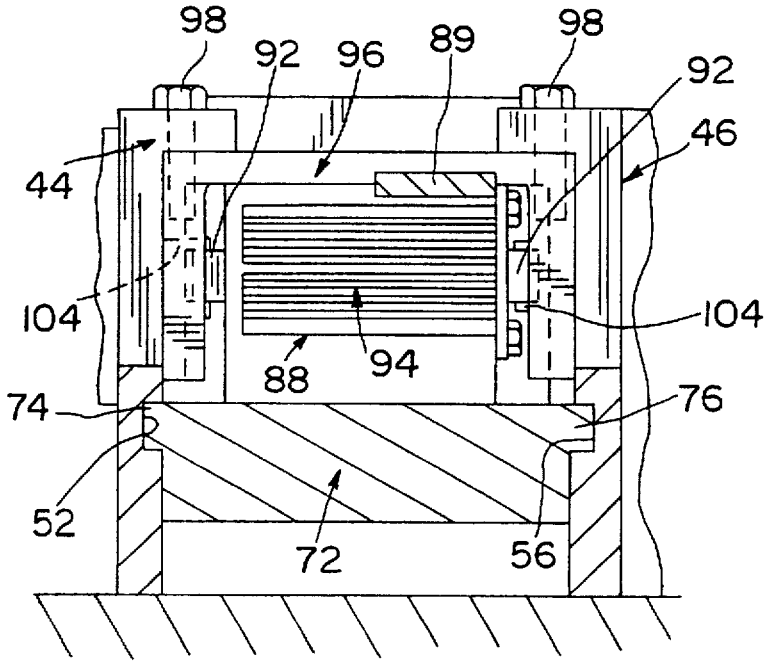
FIG. 7 is a sectional view taken along lines 7—7 of FIG. 3 illustrating details of the first jaw, a removable guide, and positive stops of the jaw assembly.

A U-shaped jaw guide 96 is coupled between support 44 and 46 by suitable fasteners 98. Fasteners 98 extend through apertures 100 and into threaded apertures 102 of jaw guide 96. Jaw assembly 70 is positioned within the track defined by grooves 52 and 56. The stops 92 on jaw 88 are located between first positive stops 104 formed on supports 44 and 46 and second positive stops defined by edges 106 of jaw guide 96. The position of the jaw guide 96 is illustrated in FIG. 7. A detailed discussion of the positive sliding clamp is provided below.

Power tong apparatus 38 includes a pair of rotating plates 108 and 110. Plates 108 and 110 include U-shaped apertures 112 and 114 respectively. Plate 108 is formed to included a semi circular grove in side wall 116. A semi-circular bearing member 118 extends between the groove 60 and the semi-circular groove (not shown) formed in plate 108 to provide a first bearing member for the power tong apparatus 38.

Plate 110 is formed to include a semi-circular groove 120 in side wall 122. A semi-circular bearing member 124 extends between groove 120 of plate 110 and groove 64 of support 48 to provide a second bearing for the power tong apparatus 38. Bearing members 118 and 124 are configured to float within arcuate grooves 60 and 120, 64 to permit rotation of plates 108 and 110 relative to supports 46 and 48. Illustratively, the arcuate grooves 60, 120 and 64 extend over a 210° angle, while bearing members 118 and 124 extend over only a 180° angle.

Although the first and second bearings are illustrated as semi-circular bearings, it is understood that these bearings may be circular bearing members extending completely around the pipe which extend between circular grooves that completely surround the pipe formed in the supports 46 and 48 and plates 108 and 110 in another embodiment of the present invention. In other words, the arcuate grooves and bearing members may all be 360°. This embodiment still permits the bearing members to float so that no welding is required. The bearing members 118 and 124 provide a large bearing surface for pivotal movement of the power tong 38.

Power tong apparatus 38 includes a jaw assembly 130. Jaw assembly 130 includes a base 132 having an upwardly extending jaw 134. Removable wedges 136, which provide the jaw teeth, are situated within slots 138 of jaw 134. An end cap 140 is then secured over the wedges 136 by fasteners 142. Jaw assembly 130 also includes a cylinder 144 coupled to a fixed support 146 of base 132 by suitable fasteners 148. Cylinder 144 includes a movable piston 150. A jaw 152 is coupled to piston 150 by a pin 154.

Plates 108 and 110 are formed to include extended grooves 126 and 128, respectively. Opposite flanges 156 and 158 of base 132 are located within grooves 126 and 128, respectively, of plates 108 and 110 so that the jaw assembly 130 can slide relative to plates 108 and 110.

Stops 160 are formed on second jaw 152. The stops 160 are located between first positive stops 162 formed on plates 108 and 110 and a U-shaped jaw guide 164 which includes stops 166. Jaw guide 164 is secured to plates 108 and 110 by fasteners 168 which extend through apertures 170 and into threaded apertures 172 of jaw guide 164.

The bearings 118 and 124 permit rotation of the power tong jaw assembly 130 and plates 108 and 110 relative to supports 46 and 48. A pair of drive cylinders 174 are used to rotate the jaw assembly 130 to break a joint connection between adjacent sections of pipe. Pistons 176 of cylinders 174 are pivotably coupled to plates 108 and 110 at locations 178 by fasteners 179. Cylinders 174 are pivotably coupled to base 16 by suitable connectors 180 and fasteners 181. Therefore, extension of pistons 176 causes rotation of plates 108 and 110 and jaw assembly 130 to break the joint connection as discussed below. The dual pivoting drive cylinders 174 have a close profile arrangement. In other words, the cylinders 174 do not extend beyond the profile of the cylinders 84 and 144 of the jaw assemblies 70 and 130, respectively. Therefore, the dual drive cylinders 174 are an improvement over conventional single drive cylinders for rotating a power tong.

Cylinders 84, 144, and 174 are coupled to a suitable hydraulic controller (not shown). The hydraulic controller supplies hydraulic fluid to the cylinders 84, 144, and 174 to extend and retract the pistons 90, 150, and 176, respectively, in a conventional manner.

FIGS. 3–6 disclose the position of a pipe locating boss 182. A locating boss 182 is positioned on both the backup tong 36 and the power tong 38. Boss 182 prevents the pipes 24 and 26 from dropping beneath the supports and jamming during insertion or removal of the pipes 24 and 26.

Figure 4:
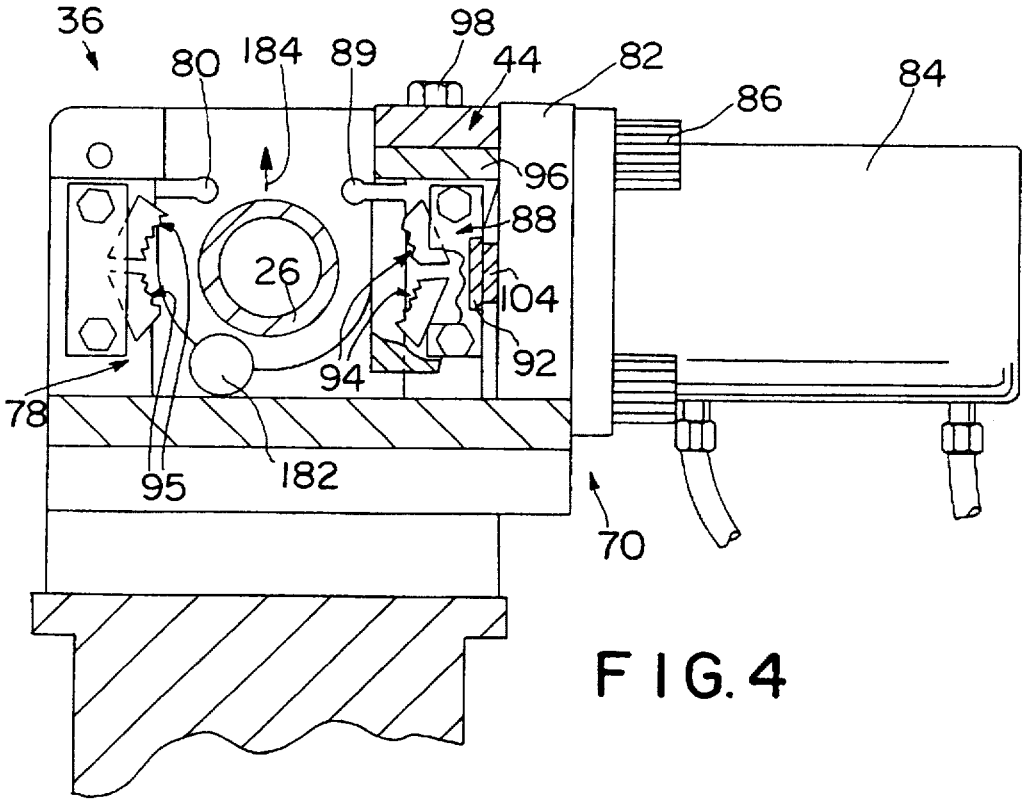
FIG. 4 is a sectional view taken along lines 4—4 of FIG. 3 illustrating the configuration of the backup tong apparatus with the jaws of the clamp in a fully open position when a piston of the backup cylinder is in a retracted position.
Figure 5:
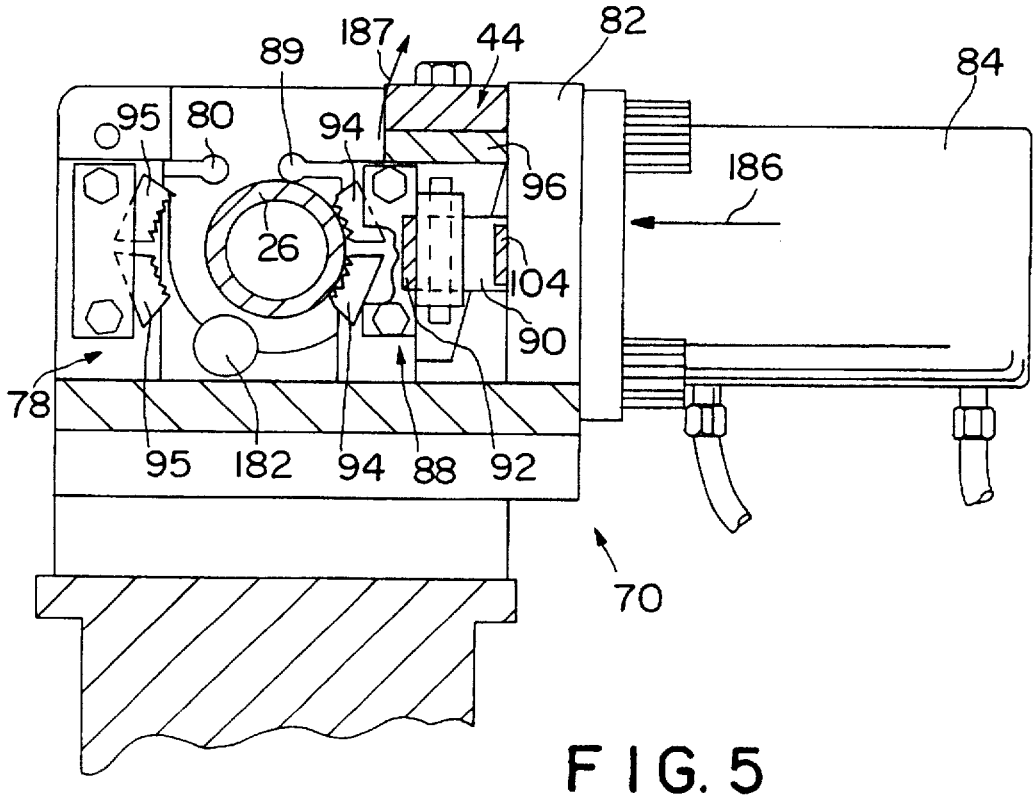
FIG. 5 is a sectional view similar to FIG. 4 in which the backup piston has been extended until the first jaw engages the pipe or a fixed positive stop.
Figure 6:
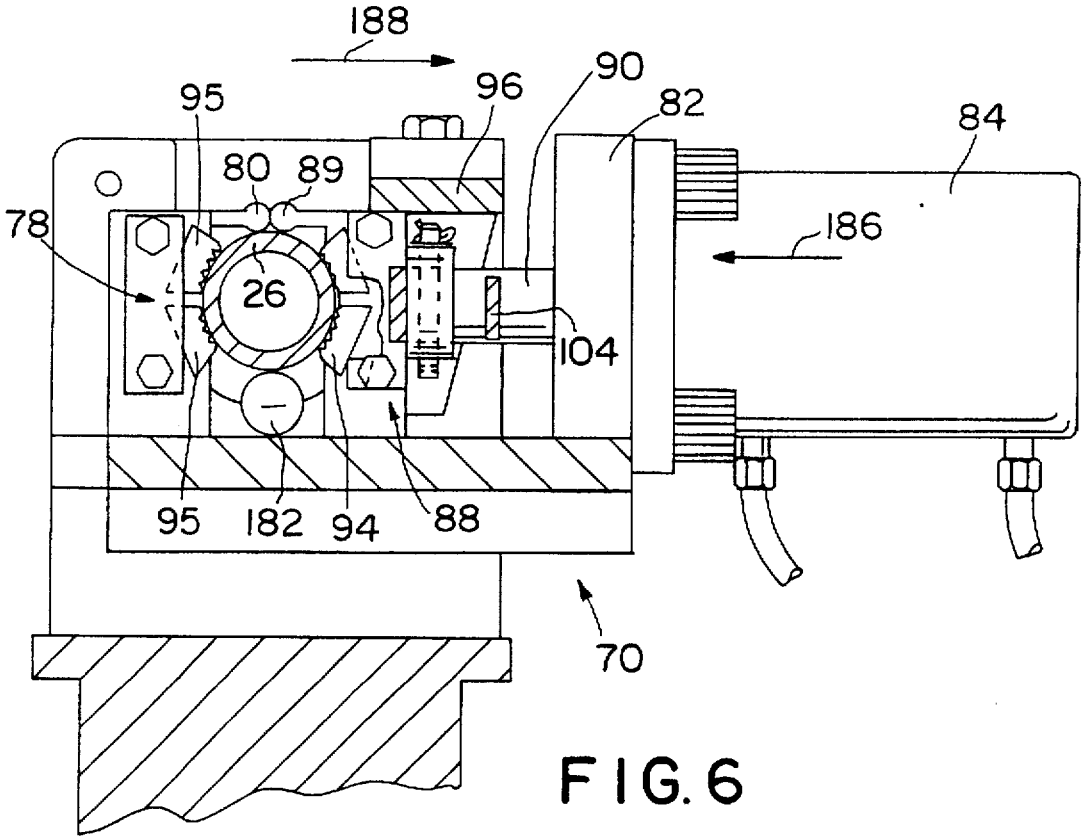
FIG. 6 is a sectional view similar to FIGS. 4 and 5 illustrating further extension of the piston to move the backup jaw assembly and the second jaw into engagement with the pipe.

FIGS. 4–6 illustrate operation of the positive sliding clamp of the backup tongs and power tongs of the present invention. In FIG. 4, teeth 95 of jaw 78 and teeth 94 of jaw 88 are all spaced apart from pipe 26. Retention fingers 80 and 89 are coupled to jaws 78 and 88, respectively, away from pipe 26. FIG. 4 illustrates the piston 90 of cylinder 84 in a retracted position so that the stops 92 on jaw 88 engage stops 104 formed on supports 44 and 46.

As piston 90 is first extended in the direction of arrow 186 in FIG. 5, jaw 88 moves in the direction of arrow 186 toward pipe 26 while the base 72 and jaw 78 remain in the position of FIG. 4. Jaw 88 continues to move in the direction of arrow 186 until either teeth 94 of jaw 88 engage pipe 26 or until the stops 92 on the jaw 88 engage the stops 106 of jaw guide 96. Therefore, stops 106 on jaw guide 96 provide positive stops for preventing further movement of jaw 88 in the direction of arrow 186 caused by extension of the piston 90. Stops 106 are positioned to align pipe 26 substantially in the center of the U-shaped apertures. Therefore, the positive stops 106 provide accurate positioning for pipe 26 during clamping of the jaws 78 and 88. Jaw guide 96 also prevents movement of jaw 88 in the direction of arrow 187 of FIG. 5. FIG. 5 illustrates jaw 88 in contact with the pipe 26 after extension of the piston 90.

After jaw 88 hits the stops 106 on jaw guide 96, further extension of piston 90 causes the base 72, the first jaw 78, and the cylinder 84 move in the direction of arrow 188 in FIG. 6 so that the teeth 95 of jaw 78 move into engagement with pipe 26.

Therefore, the jaw assembly 70 is permitted to slide relative to supports 44 and 46. However, the first set of positive stops 104 and the second set of positive stops 106 provide a positive sliding clamp for gripping pipe 26.

During retraction of the jaws 78 and 88 from pipe 26, piston 90 is retracted until stops 92 on jaw 88 engage stops 104 on supports 44 and 46. Further retraction of the piston causes base 72, the jaw 78, and cylinder 84 to move in the direction of arrow 186 back to the space apart position illustrated in FIG. 4 to release the pipe 26.

Figure 8:
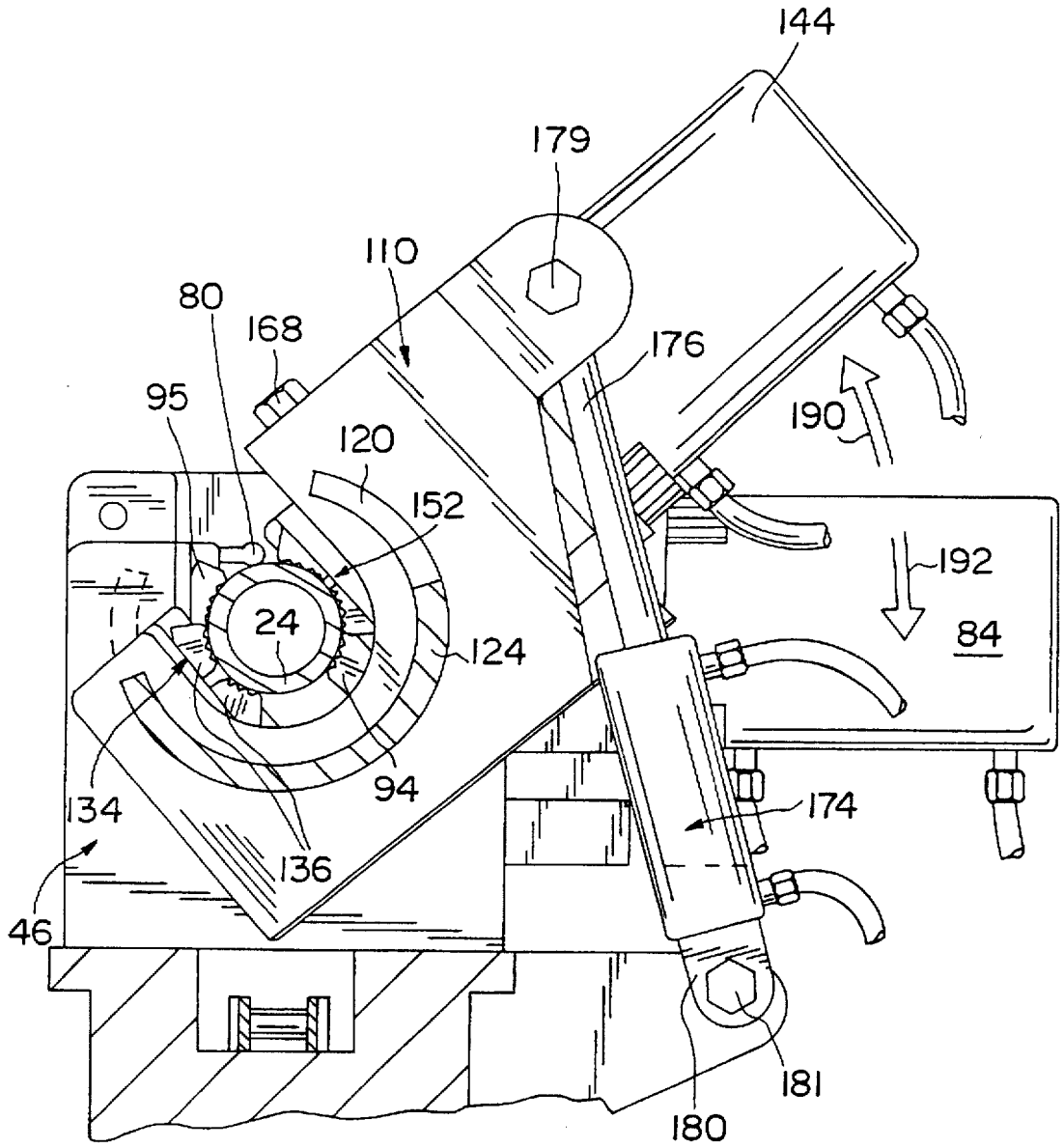
FIG. 8 is a sectional view taken along lines of 8—8 of FIG. 3 illustrating operation of the power tong apparatus to grip and rotate a pipe to break a joint connection between adjacent sections of pipe.

The gripping positive sliding clamp defined by jaws 134 and 152 of power tong jaw assembly 130 works in a manner identical to jaw assembly 70 of the back up tong apparatus 36. Once the teeth 136 of jaw 134 and the teeth 194 of jaw 152 engage and grip the pipe 24, drive cylinders 174 are actuated to extend pistons 176. Full extension of pistons 176 is illustrated in FIG. 8. Therefore, the pistons 176 rotate the plates 108 and 110, the base 132, and the first and second jaws 134 and 152 in the direction of arrow 190 to break a connection between the threaded joint connection 30 of upper pipe 24 and female joint section 32 of lower pipe 26.

After the joint connection is broken, pistons 176 are retracted to rotate the power tongs in the direction of arrow 192. Piston 150 of jaw assembly 130 is also retracted to move jaws 134 and 152 away from pipe 24. Control to main drive 12 is then actuated to continue rotation of drive head 14 about 10 revolutions to uncouple the upper pipe section 24 from the lower pipe section 26. Cylinder 150 is then actuated to extend jaws 152 and 134 again to engage the pipe 24. Main drive 12 then actuates the drive head 14 to break drive head 14 away from an upper end of pipe 24. This permits pipe 24 to be removed.

Piston 90 of cylinder 84 is then retracted to release the lower pipe 26 from jaws 78 and 88. Main drive 12 is then moved in the direction of arrow 20 in FIG. 1 so that the drive head 14 can be coupled to the lower joint section 32 to pull lower pipe 26 out of the ground 18.

Although the invention has been described in detail with reference to a certain preferred embodiment, variations and modifications exist within the scope and spirit of the present invention as described and defined in the following claims.

What is claimed is:

1. A tong apparatus for gripping a pipe, the apparatus comprising:

a support having a track, a first positive stop, and a second positive stop; and a jaw assembly having a base slidably coupled to the track of the support, the jaw assembly including a cylinder having a movable piston, the cylinder being rigidly coupled to the base, the jaw assembly also including a clamp for gripping the pipe, the clamp having a first jaw coupled to the movable piston and a second jaw coupled to the base, the first jaw having at least one stop located between the first and second positive stops of the support so that when the piston is extended from the cylinder the first jaw initially moves toward the second jaw until the first jaw engages the first positive stop, further extension of the piston causing the base, the cylinder, and the second jaw to move relative to the support toward the first jaw until the second jaw engages the pipe to grip the pipe and prevent rotation of the pipe relative to the jaw assembly and wherein retraction of the piston initially causes the first jaw to move away from the pipe prior to movement of the second jaw.

2. The apparatus of claim 1, wherein the support includes a pair of spaced apart side walls, each side wall being formed to include an elongated groove to define the track, and the base of the jaw assembly includes first and second flanges located in the elongated grooves of the support.

3. The apparatus of claim 1, wherein the first and second jaws are formed to include a plurality of teeth for gripping the pipe, the plurality of teeth on the first and second jaws being formed by removable wedge plates.

4. The apparatus of claim 1, wherein the first and second jaws each include an inwardly projecting retention finger to block movement of the pipe away from the first and second jaws.

5. The apparatus of claim 1, wherein the support is formed to include a U-shaped aperture for permitting loading of the pipes.

6. The apparatus of claim 1, wherein the first positive stop is formed by a removable jaw guide coupled to the support.

7. The apparatus of claim 1, wherein retraction of the piston initially causes the first jaw to move away from the pipe until the at least one stop on the first jaw engages the second positive stop of the support, further retraction of the piston causing the base, the cylinder, and the second jaw to move relative to the support away from the first jaw so that the second jaw is disengaged from the pipe.

8. The apparatus of claim 1, further comprising a frame, the support being pivotably coupled to the frame, and dual drive cylinders, each drive cylinder having a movable piston coupled to the support to rotate the support relative to the frame after the first and second jaws grip the pipe.

9. The apparatus of claim 8, wherein the support is formed by first and second spaced apart plates, the drive pistons being pivotably coupled to the plates and the drive cylinders being pivotably coupled to the frame.

10. The apparatus of claim 8, wherein the frame and the support are each formed to include an arcuate groove, and further comprising an arcuate bearing member extending between the arcuate groove of the frame and the arcuate groove of the support to provide a floating bearing for pivotably coupling the support to the frame.

11. The apparatus of claim 10, wherein the arcuate grooves extend over a greater angle than the floating bearing member.

12. The apparatus of claim 10, wherein the arcuate grooves and the floating bearing member all extend a full 360°.

13. A break down tong apparatus for breaking loose a connection between a first joint portion and a second joint connecting a first pipe and a second adjacent pipe, respectively, the apparatus comprising:

a frame;

a backup tong including a first support rigidly coupled to the frame, the first support including first and second positive stops, the backup tong also including a first jaw assembly having a first base slidably coupled to the first support, the first jaw assembly including a first cylinder having a first movable piston, the first cylinder being rigidly coupled to the first base, the first jaw assembly also including a first clamp for gripping the pipe, the first clamp having a first jaw coupled to the first movable piston and a second jaw coupled to the first base, the first jaw having at least one stop located between the first and second positive stops of the first support so that when the first piston is extended from the first cylinder the first jaw initially moves toward the second jaw until the first jaw engages the first positive stop of the first support, further extension of the first piston causing the first base, the first cylinder, and the second jaw to move relative to the first support toward the first jaw until the second jaw engages the first pipe to grip the first pipe and prevent rotation of the first pipe relative to the first jaw assembly;

a power tong including a second support pivotably coupled to the frame adjacent the backup tong, the second support including first and second positive stops, the power tong also including a second jaw assembly having a second base slidably coupled to the second support, the second jaw assembly including a second cylinder having a second movable piston, the second cylinder being rigidly coupled to the second base, the second jaw assembly also including a second clamp for gripping the second pipe, the second clamp having a third jaw coupled to the second movable piston and a fourth jaw coupled to the second base, the third jaw having at least one stop located between the first and second positive stops of the second support so that when the second piston is extended from the second cylinder the third jaw initially moves toward the fourth jaw until the third jaw engages the first positive stop of the second support, further extension of the second piston causing the second base, the second cylinder, and the fourth jaw to move relative to the second support toward the third jaw until the fourth jaw engages the second pipe to grip the second pipe and prevent rotation of the second pipe relative to the second jaw assembly;

wherein retraction of either of the first or second cylinders initially cause the respective first or third jaw away from the pipe prior to the second or fourth jaw; and dual drive cylinders coupled to the frame, the dual drive cylinders each having a drive piston coupled to the second support to rotate the power tong relative to the frame while the second jaw assembly is engaged with the second joint portion, thereby rotating the second joint portion relative to the first joint portion to break the connection between the first joint portion and the second joint portion.

14. The apparatus of claim 13, further comprising a bearing surrounding the pipe, the bearing being located adjacent the backup tong on an opposite side of the backup tong from the power tong.

15. The apparatus of claim 13, wherein the first and second jaws each include an inwardly projecting retention finger to block movement of the pipe away from the first and second jaws.

16. The apparatus of claim 13, wherein the first positive stops are formed by a first removable jaw guide coupled to the first support and a second removable jaw guide coupled to the second support.

17. The apparatus of claim 13, wherein the drive pistons are pivotably coupled to the second support and the drive cylinders are pivotably coupled to the frame.

18. The apparatus of claim 13, wherein the frame and the second support are each formed to include an arcuate groove, and further comprising an arcuate floating bearing member extending between the arcuate groove of the frame and the arcuate groove of the second support to provide a bearing for pivotably coupling the second support to the frame.

19. A power tong apparatus for gripping and rotating a pipe, the apparatus comprising:

a frame having first and second frame members which are formed to include arcuate grooves;

a support having first and second support plates, each of the first and second support plates having an outer side wall formed to include an arcuate groove aligned with the arcuate grooves in the first and second frame members;

first and second arcuate floating bearing members extending between the arcuate grooves of the first and second support plates and the arcuate grooves of the first and second frame members to pivotably couple the support to the frame;

a jaw assembly coupled to the first and second support members for gripping the pipe; and a drive mechanism coupled to the support for rotating the support relative to the frame.

20. The apparatus of claim 19, wherein the arcuate grooves extend over a greater arcuate angle than the first and second floating bearing members.

21. The apparatus of claim 19, wherein the arcuate grooves and the first and second bearing members are all circular in shape.

22. The apparatus of claim 19, wherein the drive mechanism includes a first drive cylinder having a first piston pivotably coupled to the first support plate and a second drive cylinder having a second piston pivotably coupled to the second support plate.

23. The apparatus of claim 19, wherein the jaw assembly includes a base slidably coupled to the first and second support plates, a cylinder having a movable piston, the cylinder being rigidly coupled to the base, the jaw assembly also including a clamp for gripping the pipe, the clamp having a first jaw coupled to the movable piston and a second jaw coupled to the base, the first jaw having at least one stop located between a first positive stop and a second positive stop formed on the support so that when the piston is extended from the cylinder the first jaw initially moves toward the second jaw until the first jaw engages the first positive stop, further extension of the piston causing the base, the cylinder, and the second jaw to move relative to the support toward the first jaw until the second jaw engages the pipe to grip the pipe and prevent rotation of the pipe relative to the jaw assembly.

24. A tong apparatus for gripping a pipe, the apparatus comprising:

a support having a track and a first positive stop; and a jaw assembly having a base slidably coupled to the track of the support, the jaw assembly including a cylinder having a movable piston, the cylinder being rigidly coupled to the base, the jaw assembly also including a clamp for gripping the pipe, the clamp having a first jaw coupled to the movable piston and a second jaw coupled to the base, the first jaw having a stop configured to engage the first positive stop of the support so that retraction of the piston when the first and second jaws are engaged with the pipe initially causes the first jaw to move away from the pipe until the stop on the first jaw engages the first positive stop of the support, further retraction of the piston causing the base, the cylinder, and the second jaw to move relative to the support away from the first jaw so that the second jaw is disengaged from the pipe.

25. The apparatus of claim 24, wherein the support includes a second positive stop spaced apart from the first positive stop; the stop of the first jaw being located between the first and second positive stops so that extension of the piston from the cylinder when the first and second jaws are disengaged from the pipe initially moves the first jaw toward the second jaw until the first jaw engages the second positive stop, further extension of the piston causing the base, the cylinder, and the second jaw to move relative to the support toward the first jaw until the second jaw engages the pipe to grip the pipe and prevent rotation of the pipe relative to the jaw assembly.

* * * * *